United States Patent [19]

Posey et al.

[11] Patent Number: 4,888,155

[45] Date of Patent: Dec. 19, 1989

[54] APPARATUS FOR STERILIZING FILM AND LIKE PACKAGING MATERIAL

[75] Inventors: John L. Posey, McHenry; Ronald W. Swank, Crystal Lake, both of Ill.

[73] Assignee: Baxter International Inc., Deerfield, Ill.

[21] Appl. No.: 35,686

[22] Filed: Apr. 7, 1987

[51] Int. Cl.[4] ..... A61L 2/18

[52] U.S. Cl. ..... 422/49; 53/167; 53/425; 422/28; 422/31; 422/32; 422/106; 422/293; 422/304

[58] Field of Search ..... 422/28, 31, 32, 293, 422/301, 304, 106, 49; 53/425, 167

[56] References Cited

U.S. PATENT DOCUMENTS

| | | | |
|---|---|---|---|
| 1,718,063 | 6/1929 | Naugle et al. . | |
| 1,999,822 | 4/1935 | Nieman . | |
| 2,234,153 | 3/1941 | Herbert . | |
| 2,967,119 | 1/1961 | Gutterman . | |
| 3,158,886 | 12/1964 | Grimes . | |
| 3,383,831 | 5/1968 | Goldsmith . | |
| 3,440,003 | 4/1969 | Tuma . | |
| 3,513,627 | 5/1970 | Doucette et al. . | |
| 3,692,468 | 9/1972 | Loliger et al. | 53/167 |
| 3,929,409 | 12/1975 | Buchner et al. . | |
| 3,947,249 | 3/1976 | Egger | 53/167 |
| 4,104,024 | 8/1978 | Vogele et al. | 53/167 |
| 4,120,656 | 10/1978 | Henningsen | 422/106 |
| 4,396,582 | 8/1983 | Kodera | 422/31 |

FOREIGN PATENT DOCUMENTS 8116 1/1968 Australia .

*Primary Examiner*—Barry S. Richman
*Assistant Examiner*—Timothy M. McMahon
*Attorney, Agent, or Firm*—Paul E. Schaafsma; Robert M. Barrett; Paul C. Flattery

[57] ABSTRACT

An apparatus for sterilizing packaging material is provided. The apparatus includes a container or bath for containing a liquid sterilant through which the packaging material is drawn and guided. The container having an entry opening and exit opening, and guide rollers. At least one spray nozzle located at a position above the level of liquid sterilant for spraying the packaging material with recirculated filter liquid sterilant after it has passed through the liquid sterilant bath is provided.

11 Claims, 3 Drawing Sheets

FIG. 5
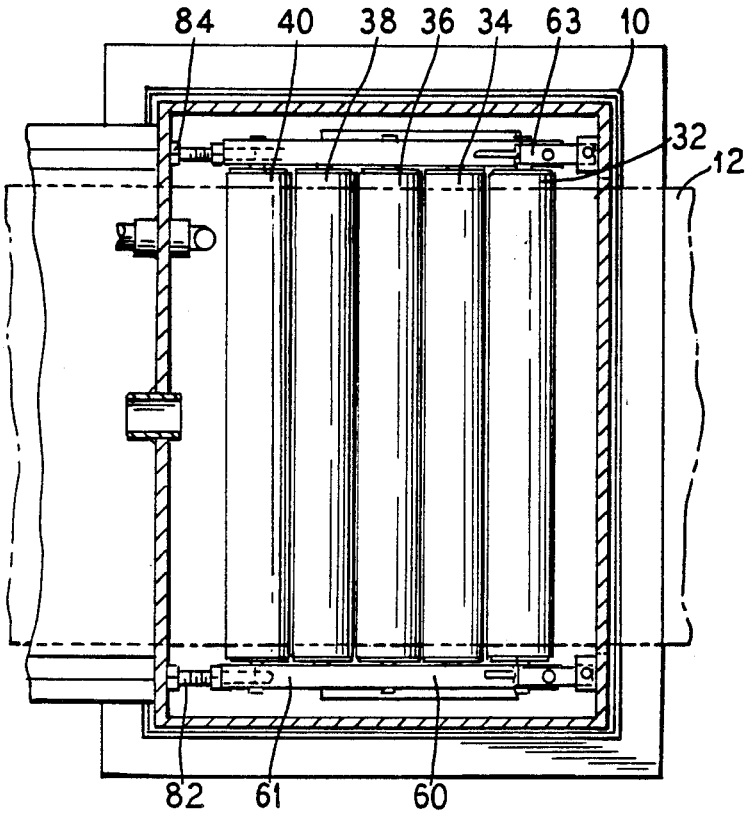
FIG. 6
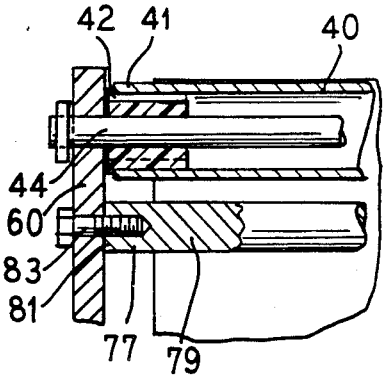
FIG. 7
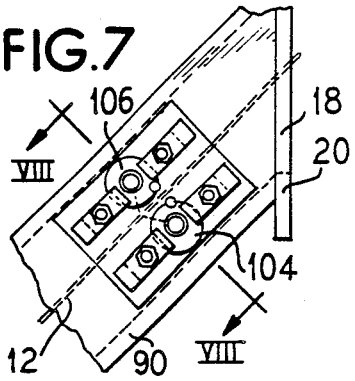
FIG. 9
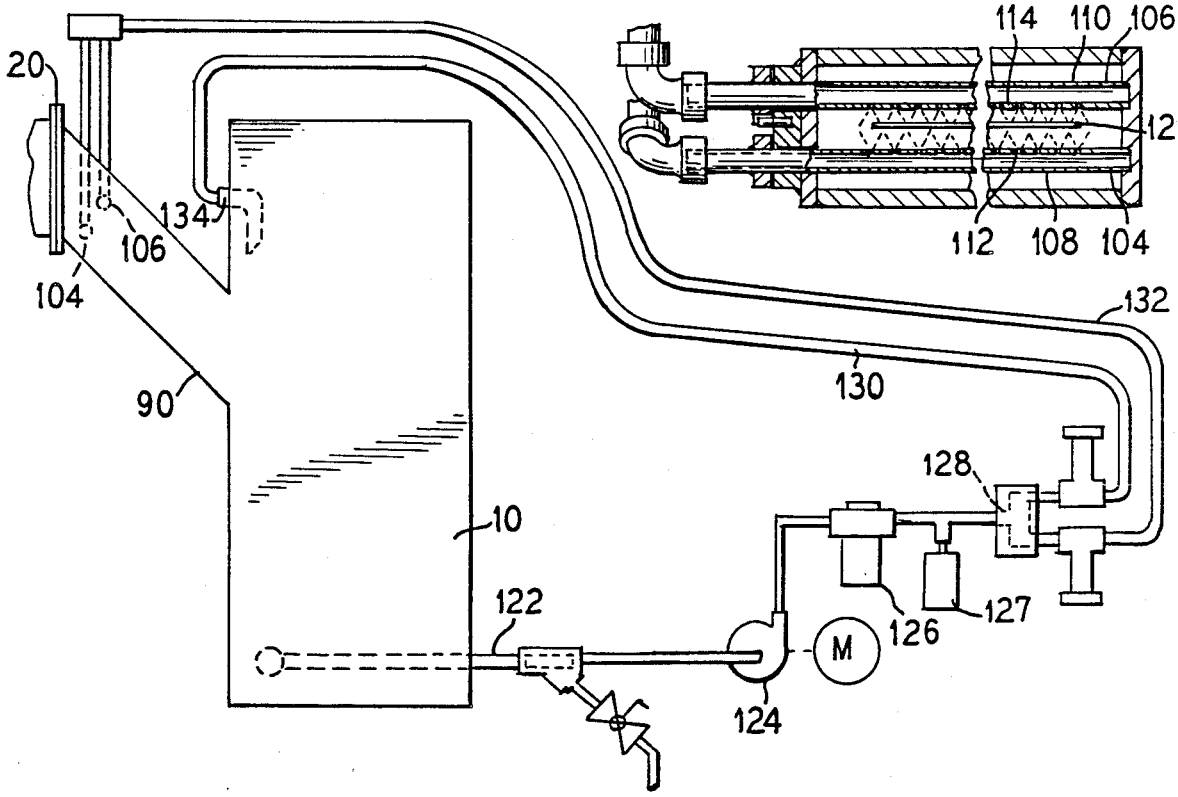
FIG. 8

APPARATUS FOR STERILIZING FILM AND LIKE PACKAGING MATERIAL

The present invention generally relates to methods of apparatus for sterilizing flexible packaging material. More specifically, the present invention relates to a method of an apparatus for sterilizing flexible film before it is fed into a packaging machine.

In a typical packaging machine, a web of packaging material is fed into the machine that forms and fills packages with a product. An example of such a machine, is a form, fill, seal packaging machine. In a form, fill, seal packaging machine a web of flexible film is fed into the packaging machine, formed into a tubular or similar shape, filled with the product, and then sealed.

In some types of packaging art including, inter alia, pharmaceutical, food products, and dairy products, it is necessary for the product to be packaged in a sterile or aseptic manner. Accordingly, the web of film that is to contain the product should be fed into the packaging machine in a sterile or aseptic condition having a minimal amount of particulate. This is especially true in the pharmaceutical field where strict regulatory guidelines limit the amount of particulate that may be found in the resultant product.

It is known to feed a web of fil that is to be utilized to create a package to house products through a bath to sterilize and/or clean the film. The bath typically includes some type of liquid sterilant, for example, hydrogen peroxide. The bath typically includes a plurality of rollers that guide the film through the bath and insure that the film has a sufficiently long dwell time in the liquid sterilant. A sufficiently long dwell time is needed to afford a sufficient kill. In aseptic packaging, such as in the pharmaceutical field, a sterility assurance level of $10^{-6}$ is required.

The bath also functions to not only sterilize the film but loosen and remove particulate from the surface of the film. As stated above in certain fields, such as the pharmaceutical field, particulate in the resultant product must be limited. Therefore, the bath not only functions to sterilize the film but also removes a sufficient amount of particulate from the surface of the film.

An example of a bath in U.S. Pat. No. 3,929,409. The apparatus disclosed in U.S. Pat. No. 3,929,409 functions to sterilize a web of film by passing the film through a sterilizing liquid and subsequent passage through a neutralizing liquid. Prior to or during passage through the sterilizing bath, the material is exposed to a high-velocity stream of sterilizing liquid emanating from liquid scouring nozzles. After passage through the sterilizing bath, as well as passage through the neutralizing bath, the packaging material is exposed to a high-velocity stream of sterile gas to dry the film.

Typically, particulate is removed from the film as the film is guided through the bath. Accordingly, the particulate that is removed from the film remains in the bath solution. Because the bath solution contains the removed particulate, the film can be recontaminated with particulate as it dwells within the bath. Accordingly, although particulate may have been removed from the film, it is possible for particulate to recontaminate the surface of the film as the film continues to dwell in the bath.

There is therefore a need for an improved apparatus for sterilizing a web of film before the film enters a packaging machine.

The present invention provides an apparatus for sterilizing packaging material before it is fed into a packaging machine. The apparatus includes a container for containing a liquid sterilant bath through which the packaging material is drawn and guided. The container includes an inlet opening, an outlet opening, and guide means for guiding the packaging material through the liquid sterilant bath. The apparatus also includes at least one spray nozzle for spraying recirculated filtered liquid sterilant on the film after it has exited the liquid sterilant.

Preferably, the spray nozzle is located in a conduit between the container and a packaging machine. The conduit provides a hydrolock between the container and packaging machine. Preferably, two opposing spray nozzles are provided, and each spray nozzle includes an elongated member having a plurality of apertures.

A method of sterilizing and cleaning packaging material before it enters a packaging machine is also provided. The method includes passing the material through a liquid sterilant bath and spraying the material after it has exited the liquid sterilant with recirculated filtered liquid sterilant.

Accordingly, it is an advantage of the present invention to provide an improved apparatus for sterilizing and cleaning packaging material.

It is a further advantage of the present invention to provide a hydrogen peroxide bath that can be utilized with a form, fill, seal packaging machine to provide a sterile product.

A still further advantage of the present invention is to provide a hydrogen peroxide bath that can be utilized with a form, fill, seal packaging machine to provide a packaging machine for making pharmaceutical products.

Moreover, an advantage of the present invention is to provide a bath that insures that a majority of the particulate matter is removed from a web of film before it enters a packaging machine.

A still further advantage of the present invention is to provide an apparatus that is able to sterilize a web of film and feed the film into the machine in a sterile condition.

Furthermore, an advantage of the present invention is that it provides a machine that affords a safe environment for the operators in the vicinity of the packaging machine.

Still an advantage of the present invention is to provide an improved method for sterilizing and cleaning a web of film before it enters a packaging machine.

A further advantage of the present invention is to provide a means for recirculating the liquid sterilant in the bath.

Additional features and advantages of the present invention are described in, and will be apparent from, the detailed description of the presently preferred embodiments and from the drawings.

FIG. 5 illustrates a cross-sectional view of the apparatus taken along lines V—V of FIG. 3.

FIG. 6 illustrates a cross-sectional view of the apparatus taken along lines VI—VI of FIG. 3.

FIG. 7 illustrates a cross-sectional view of a portion of the apparatus for sterilizing and cleaning a web of film of the present invention.

FIG. 8 illustrates a cross-sectional view of the portion of the apparatus illustrated in FIG. 7, taken along lines VIII—VIII of FIG. 7.

FIG. 9 illustrates a schematic of the system for providing sterilant to the apparatus for sterilizing and cleaning a web of film.

Figure 1:
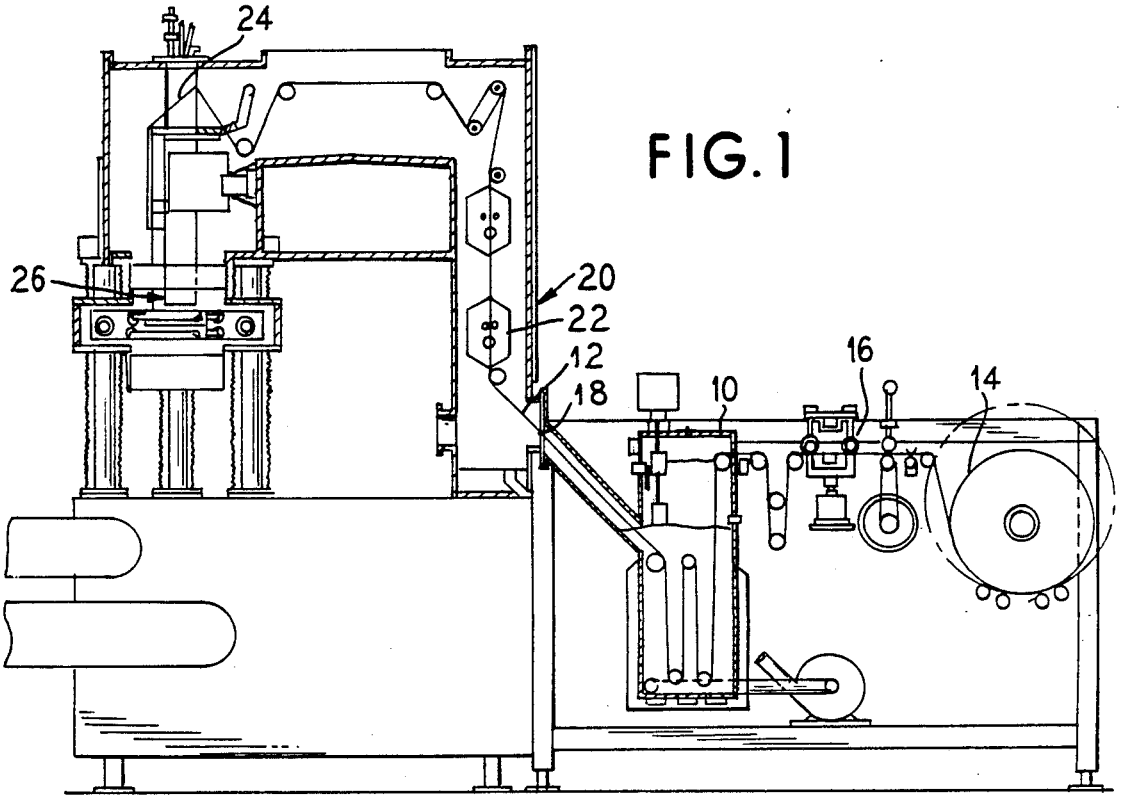
FIG. 1 illustrates a cross-sectional perspective view of a form, fill, seal packaging machine incorporating the apparatus for sterilizing and cleaning a web of the film of the present invention.

Referring now to FIG. 1, the apparatus for sterilizing and cleaning packaging material, hereinafter described as a bath 10, is illustrated. The bath 10 is illustrated in combination with a form, fill, seal packaging machine 20. Although, the bath 10 is illustrated as being connected to a form, fill, seal packaging machine, it should be appreciated that the bath 10 can be utilized with other types of packaging machines or in analogous art to sterilize and/or clean packaging material and the like.

In a typical packaging machine 20 illustrated in FIG. 1, packaging material, e.g., a web of film 12, is fed from a feed source 14 through a splicing station 16 into the bath 10. As described in more detail below, the bath 10 functions to sterilize and clean the web of film 12 before the film enters the packaging machine 20. The film enters the packaging machine through an entry port 18 and is fed past at least one aseptic air knife 22. The aseptic air knife functions to direct a high-velocity curtain of air against a surface of the film drying the film and removing residue. After passing by the aseptic air knife(s) 22, the film 12 is fed to a former or mandrel station 24 where the film 12 is formed into a tubular shape. The film 12 is then fed to a sealing and packaging station 26 wherein a side and bottom seal is created in the film, the resultant tubular package is filled with a product, a second side seal is created, and the film is severed into individual bags or containers.

Figures 3, 4:
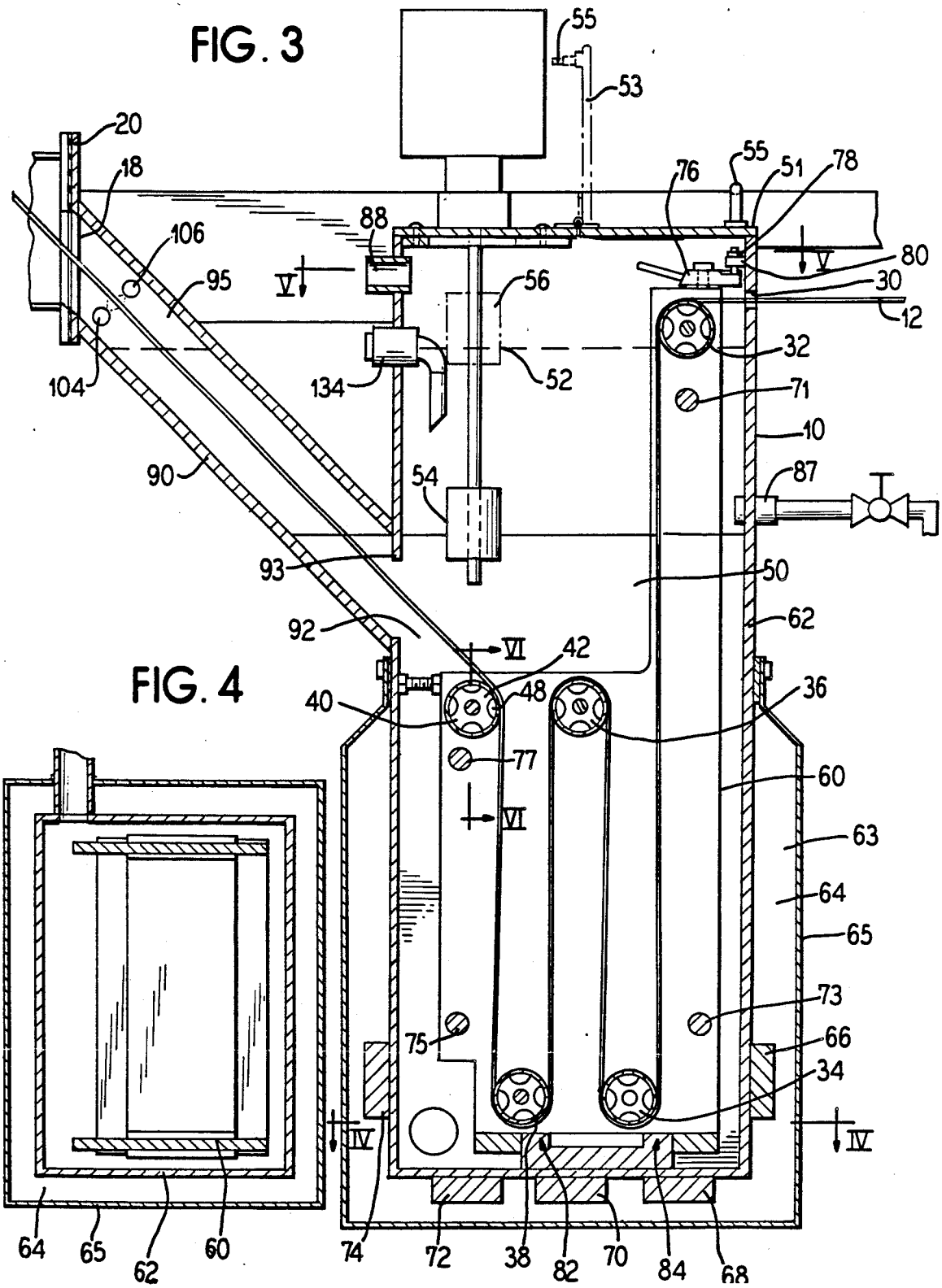
FIG. 3 illustrates a cross-sectional view of the apparatus taken along lines III—III of FIG. 2.
FIG. 4 illustrates a cross-sectional view of the apparatus taken along lines IV—IV of FIG. 3.

Referring now to FIG. 3, a cross-sectional view of the bath 10 is illustrated. As illustrated, the bath 10 includes an entry port 30 where the film 12 is fed into the bath 10. The entry port 30 has a longitudinal length at least sufficiently long to allow the film 12 to be fed therein. The width of the entry port 30, although great enough to allow the film 12 to be fed into the bath 10, is preferably small to reduce the amount of fumes that will escape from the bath 10. It is important to note, however, that the entry slot 30 has a sufficient dimension to allow the film 12 to enter the bath 10 without touching any of the sides of the slot 30 so that the film is not damaged or the amount of particulate on its surface increased.

As illustrated in FIGS. 3 and 5, the bath 10 includes a plurality of guide rollers 32, 34, 36, 38, and 40. The guide rollers 32, 34, 36, 38, and 40 direct the film 12 through the bath 10 and function to afford the film a sufficient dwell time within the solution in the bath 10. To this end, the film travels through the slot 30 around guide roller 32, downwardly into the solution, around a second guide roller 34, upwardly around a third guide roller 36, downwardly around a fourth guide roller 38, and upwardly passed a fifth guide roller 40. If desired, more or less guide rollers can be utilized.

Referring to FIG. 6, a cross-sectional view of a portion of one of the guide rollers 40 is illustrated. It should be noted that all of the guide rollers 32, 34, 36, 38, and 40 have a similar construction so that only one guide roller 40 will be discussed. The guide roller 40 includes a tubular sleeve 41 that is preferably constructed from electro-polished 316 stainless steel. The guide roller 40 also includes a high molecular polyethylene polymer bushing 42. The bushing 42 is mounted to a shaft 44 that is secured to a side of a carriage 60 of the bath 10.

As illustrated in FIGS. 3 and 6, the bushing 42 of the guide roller 40 includes scalloped portions 48. The scalloped portions 48 of the bushings 42 allow liquid sterilant to enter and drain out of the guide roller 40. The high molecular polyethylene polymer bushing 42 affords the roller 40 with a low coefficient of friction that prevents damage and scratching of the film 12. The utilization of electro-polished guide rollers 32, 34, 36, 38, and 40, also functions to prevent the guide rollers from scratching or damaging the film 12 as the film is pulled through the bath 10. Moreover, due to their construction, the guide rollers 32, 34, 36, 38, and 40 are light-weight.

As previously stated, the bath 10 includes a liquid sterilant. The liquid or chemical sterilant functions to clean the film and kill the majority of organisms that contaminate the film. Although preferably the liquid sterilant is hydrogen peroxide, it is possible to utilize other liquid sterilants such as, for example, hot water, peracetic acid, chlorine, and other liquid or chemical sterilizing agents. In applications of the bath 10 in the pharmaceutical field were a $10^{-6}$ kill is required, it has been found that preferably the liquid sterilant is a hydrogen peroxide-water mixture, consisting of approximately 25 to about 40% hydrogen peroxide.

As illustrated, the liquid sterilant 50 is maintained in the bath 10 between an upper level 52 and a lower level 54. The upper level 52 maintains the liquid sterilant at a position sufficiently low so that the hydrogen peroxide does not leak out the entry slot 30. As discussed in more detail below, the lowest level 54 of the liquid sterilant 50 corresponds to a point that will afford a hydrolock, as illustrated in FIG. 3, between the bath 10 and the packaging machine 20. An alert float switch 56 signals the operator if the level of liquid sterilant 50 is too low or too high. If desired, the level of liquid sterilant 50 can be varied between levels 52 and 54. By varying the level of liquid sterilant 50, the dwell time of the film 12 in the liquid sterilant is varied and thereby the kill can be varied.

Figure 2:
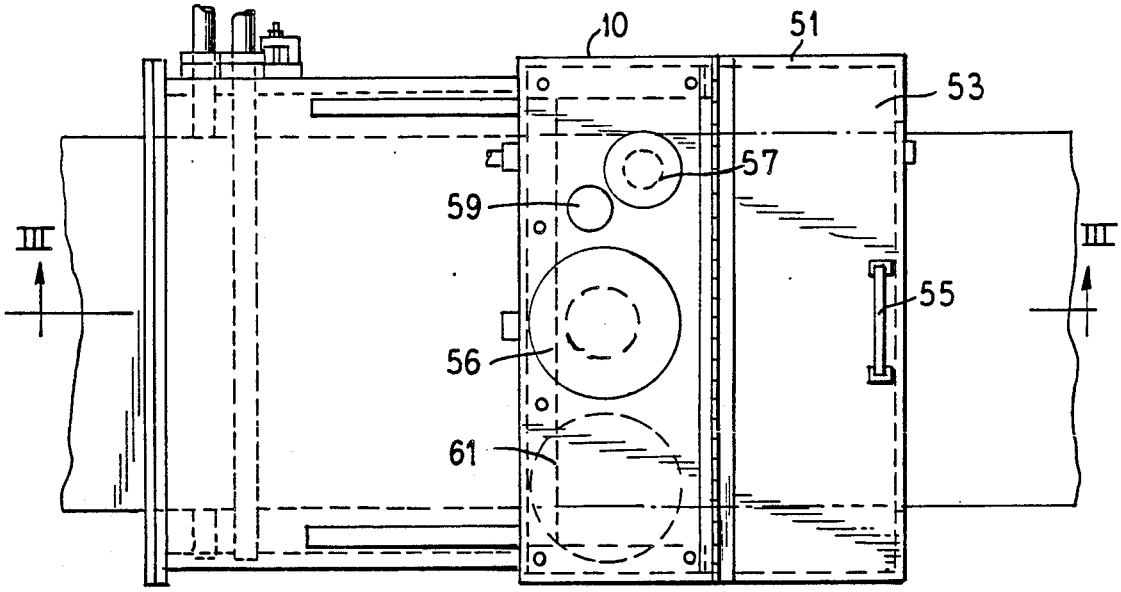
FIG. 2 illustrates a top elevational view of the apparatus for sterilizing and cleaning a web of film of the present invention.

It will be appreciated that during the sterilization and cleaning process of the film 12, liquid sterilant will be lost. Accordingly, it is necessary to refill the liquid sterilant level at certain intervals. As illustrated in FIG. 2, the top portion 51 of the bath 10 includes an openable lid 53 and latch 55. The lid 53 and latch 55 allow additional sterilant to be added to the bath 10 as needed. As also illustrated in FIG. 2, the top portion 51 of the bath 10 includes a temperature gauge 57 and a thermocouple 59 for monitoring the temperature of the liquid sterilant 50. An optional float switch 61 can also be provided.

The bath 10 includes an outer housing 62. Preferably, the outer housing is constructed from 316 stainless steel. The outer housing 62 of the bath 10 includes a lower portion 63 that includes a shell 65. The shell 65 is preferably constructed from 316 stainless steel. Beneath the shell 65 and between the shell and the remaining lower portion of the outer housing 62 of the bath 10 is located insulation 64 and heaters 66, 68, 70, 72, and 74. Although five heaters 66, 68, 70, 72, and 74 are illustrated more or less heaters can be utilized depending upon requirements. The heaters 66, 68, 70, 72, and 74 function to heat the liquid sterilant 50. Preferably, the heaters 66, 68, 70, 72, and 74 are strip heaters. Preferably, the insulation 64 comprises high density fiberglass. If the liquid sterilant 50 is hydrogen peroxide and a kill of $10^{-6}$ is desired, it has been found that the bath 10 should be maintained at a temperature of approximately 150° to about 170° F.

Located within the outer housing 62 of the bath 10 is a carriage 60. The carriage 60 includes sides 61 and 63 that are secured together by a plurality of brackets 71, 73, 75, and 77. As illustrated in FIG. 6, the brackets 77 include elongated bars 79 that have threaded apertures 81 for receiving a bolt 83. Because the brackets 71, 73, 75, and 77 are located within the solution of the bath 10, they are preferably constructed from 316 stainless steel.

As discussed above, the guide rollers 32, 34, 36, 38, and 40 are secured to the sides 61 and 63 of the carriage 60. The carriage 60 is removably secured within the outer housing 62 of the bath. To this end, the carriage 60 includes a hold down latch 76 that secures the carriage to the body 62 of the bath. To remove the carriage 60, the hold down latch 76 is biased so that a bolt 78 disengages a latch member 80 of the outer housing 62 of the bath 10. This allows the carriage 60 to be removed for cleaning, inspection, or to replace the guide rollers 32, 34, 36, 38, and 40 or other parts. To secure the carriage 60 in proper position within the outer housing 62, locating pins 82 and 84 for locating the carriage 60 in the outer housing 62 of the bath 10 are provided.

The bath 10 includes a sampler port 87 that allows one to sample the liquid sterilant 50 for testing purposes. The sampler port 87 can be any sampler port known in the art. The bath 10 also includes an exhaust port 88 for exhausting the liquid sterilant vapors. Likewise, the exhaust port 88 can be any exhaust port known in the art.

Located between the bath 10 and the packaging machine 20 is a conduit 90. The conduit 90 affords communication between the exit 92 in the bath 10 and the entry opening 18 in the packaging machine 20. The conduit 90 cooperates with the bath 10 to provide a hydrolock. The conduit 90 is bolted and gasketed to the bath 10 and to the packaging machine 20. As illustrated, the conduit 90 includes a level of liquid sterilant 50 and provides a sterile environment through which the film 12 can pass into the packaging machine 20. The conduit 90 is preferably constructed from 316L stainless steel.

A hydrolock is created in the conduit 90 by insuring that the liquid sterilant 50 level is maintained at least above level 54. Accordingly, the liquid sterilant cooperates with a portion 93 of the bath 10 to insure an air lock is created within the conduit 90. Therefore, a positive pressure is maintained within the conduit 90. Because the liquid sterilant level never drops below the lowest level 54 the film 12 is always in a sterile environment. Thus, the conduit 90 functions to provide a sterile pathway by which the film 12 can be fed into the packaging machine 10.

Located in an upper end 95 of the conduit 90 above the level of the liquid sterilant are two spray nozzles 104 and 106. The spray nozzles 104 and 106 function to spray a curtain of liquid sterilant onto the film 12 as the film exists the liquid sterilant. The spray nozzles 104 and 106 function to remove any particulate that was not removed by the bath 10 or may have accumulated on the film 12 as the film dwelled in the bath 10. Accordingly, the spray nozzles 104 and 106 function to insure that a majority of particulate material on the surface of the film 12 is removed before the film 12 enters the packaging machine 20.

Referring to FIGS. 7 and 8, the spray nozzles 104 and 106 are illustrated in more detail. The spray nozzles 104 and 106 comprise elongated tubes 108 and 110, respectively, that include a plurality of apertures 112 and 114, respectively, located along the length of the tubes 108 and 110. The apertures 112 and 14 are constructed so that a high velocity curtain of liquid sterilant is exerted against the surface of the web of film 12. Accordingly, the apertures 112 and 114 extend along the length of the elongated tubes 108 and 110 for a distance at least equal to the width of the film 12.

The liquid sterilant that is fed through the spray nozzles 104 and 106 is recirculated filtered liquid sterilant from the bath 10. Therefore, the majority of the particulate material that is contained in the liquid sterilant solution has been removed. The nozzles 104 and 106 are located so that the liquid sterilant is sprayed at the film 12 at an angle of approximately 10° to about 40°. Most preferably, the nozzles 104 and 106 are located at an angle of approximately 30° with respect to the surface of the film 12.

Referring to FIG. 9, a schematic of the liquid sterilant flow within the bath 10 is illustrated. As illustrated, liquid sterilant is removed from the bath 10 through a drain-suction line 122. A pump 124 receives the liquid sterilant from the bath 10 and pumps it through a 5 micron filter 126. The liquid sterilant is then by a pressure transducer 127 and pumped through a manifold 128 where it can be pumped through pipes 130 and 132. Pipe 132 provides the liquid sterilant to the spray nozzles 104 and 106. If desired, the liquid sterilant can be pumped through pipe 130 to an optional recirculation port 134. Accordingly, before the recirculated liquid sterilant is sprayed through the nozzles 104 and 106, it is filtered through a 5 micron filter to reduce particulate content.

By recirculating the liquid sterilant through the spray nozzles 104 and 106, or if desired through the optional recirculation port 134, an improved liquid sterilant solution for the bath 10 is provided. The liquid sterilant solution is improved in that the particulate matter in the solution is reduced as the solution is filtered through the 5 micron filter before entering the nozzles 104 and 106. Moreover, by spraying the liquid sterilant through the nozzles 104 and 106, typical temperature gradients created in the solution in the bath 10 are reduced. As stated above, if desired, temperature gradients can be reduced and the liquid sterilant solution cleaned by circulating the solution through the recirculation port 134.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. An apparatus for sterilizing and cleaning packaging material comprising:

a container for containing a liquid sterilant bath through which packaging material is drawn and guided, the container having an entry opening, an exit opening, and means for guiding the packaging material through the liquid sterilant bath;

at least one spray nozzle located at a position above the level of the liquid sterilant for spraying the packaging material with recirculated filtered liquid sterilant after the packaging material has been drawn through the liquid sterilant in the bath to remove residue particulate from the packaging material;

conduit means for providing a hydrolock between the container and an environment into which the packaging material is being fed, the hydrolock being so constructed and arranged so that it receives a portion of the liquid sterilant, the spray nozzle being located in the hydrolock, the conduit means extending from the container to the environment into which the packaging material is being fed, and having an inlet opening secured to an exit opening of the container and an outlet opening in fluid communication with the environment, the conduit extending from a side of the container at an acute angle, the container including a wall that extends across a portion of the inlet; and a liquid sterilant level in the container being at least higher than a lower end of the wall and a liquid sterilant level in the conduit being lower than the spray nozzle.

2. The apparatus of claim 1 wherein the spray nozzle includes an elongated tube having a plurality of apertures.

3. The apparatus of claim 2 including two spray nozzles.

4. The apparatus of claim 3 wherein the apertures of the spray nozzles are oriented at an angle of approximately 10° to about 40° with respect to the film.

5. An apparatus for sterilizing and cleaning a web of film before it enters a packaging machine comprising:

a container for containing a liquid sterilant through which a web of film is drawn and guided, the container including an entry slot for allowing the film to be fed into the container, and an exit port for allowing the film to exit the container, the container including a plurality of guide rollers for guiding the film through the container;

a hydrolock means located between the exit port of the container and an entry opening of the packaging machine for providing the hydrolock between the container and the packaging machine, the hydrolock means cooperating with the container to receive a portion of the liquid sterilant, the hydrolock means includes a conduit having an inlet opening secured to the exit port of the container and an outlet opening secured to the packaging machine, the conduit extending from the container at an acute angle, the conduit receiving at least a portion of the liquid sterilant and having a positive pressure therein;

the hydrolock means including spray nozzle means for spraying filtered recirculated liquid sterilant on the film after the film has exited the liquid sterilant in the hydrolock means and before it enters the entry opening in the packaging machine to remove residue particulate from the film; and the container including liquid sterilant level means for maintaining the liquid sterilant between an upper level and a lower level, the container further including a wall, a portion of which extends downwardly across a portion of the inlet opening of the conduit when the conduit is secured to the container preventing fluid communication across a portion of the inlet opening of the conduit, the liquid sterilant in the container when the liquid sterilant is at the lower level being above a lower end of the wall, and the liquid sterilant in the conduit when the liquid sterilant in the container is at the upper level being below the spray nozzle means.

6. The apparatus of claim 5 including a recirculation port for recirculating filtered liquid sterilant.

7. The apparatus of claim 5 wherein the spray nozzle means includes at least two spray nozzles, each spray nozzle having an elongated member including a plurality of apertures, at least one spray nozzle being located on a first side of the film and at least one spray nozzle being located on a second side of the film.

8. The apparatus of claim 7 wherein the apertures of the spray nozzles are located at an angle of approximately 15° to about 45° with respect to the surface of the film.

9. The apparatus of claim 5 wherein the guide rollers are constructed from stainless steel and having bushings constructed from a high molecular polyethylene polymer.

10. The apparatus of claim 9 wherein the container includes a removable carriage and the guide rollers are secured to the carriage.

11. The apparatus of claim 9 wherein the guide rollers are constructed from a highly polished material to prevent scratching of the film.

* * * * *